United States Patent [19]

Brand et al.

[11] Patent Number: 4,948,099

[45] Date of Patent: Aug. 14, 1990

[54] COVER FOR A POST MADE OUT OF BOX SECTION FOR ENCLOSURES ESPECIALLY THOSE MADE OUT OF WOVEN FENCING

[75] Inventors: Werner Brand, Hagen; Gerhard Rohr, Schwerte; Heinz Werner, Warstein; Holger Schwarzfeller, Düsseldorf-Eller, all of Fed. Rep. of Germany

[73] Assignees: Hoesch Aktiengesellschaft, Dortmund; Schwarzfeller Draht+ Zaun GmbH, Düsseldorf, both of Fed. Rep. of Germany; Zaun GmbH, Düsseldorf, both of Fed. Rep. of Germany

[21] Appl. No.: 333,110

[22] Filed: Apr. 4, 1989

[30] Foreign Application Priority Data

May 5, 1988 [DE] Fed. Rep. of Germany ..... 3815348

[51] Int. Cl.[5] ..... B21F 27/00

[52] U.S. Cl. ..... 256/47; 256/32

[58] Field of Search ..... 256/47, 32

[56] References Cited

U.S. PATENT DOCUMENTS 2,935,304 5/1960 Hewson ..... 256/47

3,410,527 11/1968 Uroshevich ..... 256/32

*Primary Examiner*—Andrew V. Kundrat

*Attorney, Agent, or Firm*—Max Fogiel

[57] ABSTRACT

A cap with a covering portion to cover a post having a rectangular-shaped cross-section for holding woven fencing having longitudinal rods. The cap is formed from a sheet metal blank and has a cover component that may be secured to the post. This cover has a width equal to the width of the post, and a depth which is greater than that of the post. The cap has an excess portion which extneds beyond the depth of the post and is provided with cut-outs along a section of an edge adjacent to the post. Free ends of sections connected to the cover have joggs extending from the cover to the cross-section of the post and matching cross-sections of the longitudinal rods in the fencing. These sectoins connected with a cover have excess portions extending beyond the depth of the post with slits to form webs extending to bases of the excess portions.

8 Claims, 2 Drawing Sheets

COVER FOR A POST MADE OUT OF BOX SECTION FOR ENCLOSURES ESPECIALLY THOSE MADE OUT OF WOVEN FENCING

The invention concerns a cover that is made out of a sheet-metal blank and that can be applied and secured to a post made out of box section for enclosures using woven fencing.

Posts for enclosures that use woven fencing usually consist of lengths of metal box section. In one particular means of securing the fencing to the post, the wall of the post that faces the fencing has a longitudinal slot, and a strip that covers the joint between two sections of fencing in the vicinity of the post snaps into the slot. The snap-in strip prevents the fencing from coming loose when the post is lifted. Webs or flanges that project out of the post, that are usually welded to it, and that engage behind the first or last vertical rod in the fencing prevent the fencing from coming loose from the post in the event of tension along the circumference of the enclosure or due to buckling on the part of the fencing. A cover on the post that extends beyond it to the thickness of the fencing prevents it from being lifted out and coming loose. The covers are made out of sheet-metal blanks and either directly welded to the posts or secured to webs welded into them. Welds on the posts require appropriate subsequent processing to protect them from corrosion.

With the aforesaid state of the art as a point of departure, the object of the present invention is to avoid welds to the greatest possible extent in enclosures of the aforesaid type and especially to provide an effective means of associating the cover with the post that is a component of the enclosure.

The cap in accordance with the invention is positioned on the post once the latter is in place either from above or from the side facing away from the fencing and secured to the post by bending down a lower web created out of the slitted excesses of the section of the cap's edge by way of their jog. The fencing is then applied, with the ends of its upper longitudinal webs fitting into the jogs in the sections of the cap's edge that extend transversely across the enclosure and with the webs created from the excesses of the sections of the edge that have jogs engaging behind the first or the last vertical rod in the fencing. The initial function of the webs that engage behind the vertical rods at the end of the fencing and demarcate the bottom of the jogs in the sections of the cap's edge that extend transversely across the fencing is just to facilitate assembly, and the fencing, suspended on the webs by its upper longitudinal rods, is eventually secured to the posts with the strips that cover it and snap into the posts. The webs then assume the function of preventing the fencing from coming loose subject to tension along the circumference of the enclosure and render the long conventional webs or flanges welded to the posts superfluous. The laborious subsequent welding is also accordingly unnecessary. The posts can now be simply manufactured out of already surface-treated materials. The webs that engage behind the upper longitudinal rods in the fencing and project beyond the sections of the cap's edge that extend transversely across the enclosure will also prevent the cap from being pulled off the posts.

Embodiments of the invention will be evident from the subsidiary claims, 2 through 7. The cap in accordance with the invention can also be employed to the same advantage in conjunction with other methods of securing the fencing to the posts.

The invention is illustrated in detail in the drawing, wherein

Figure 3:
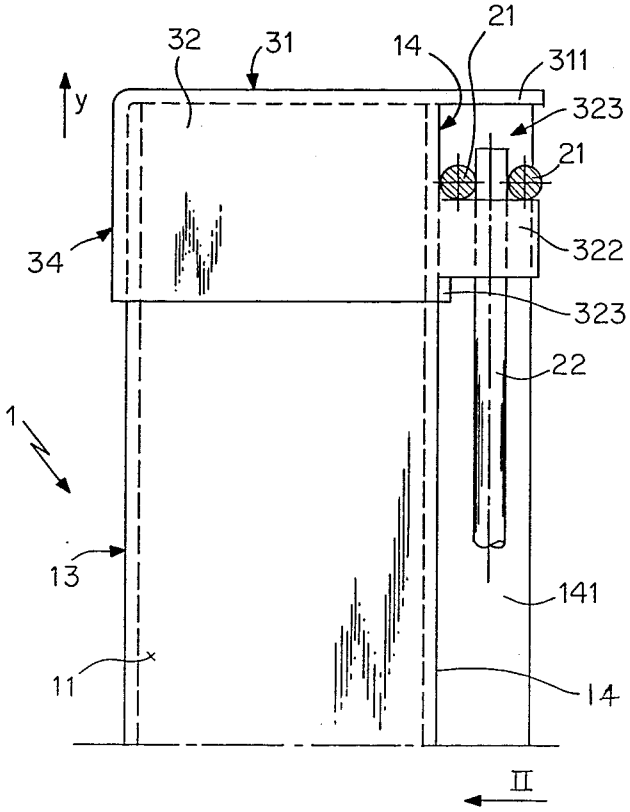
FIG. 3 is a view of the post along the direction indicated by arrow III in FIG. 2.
Figure 2:
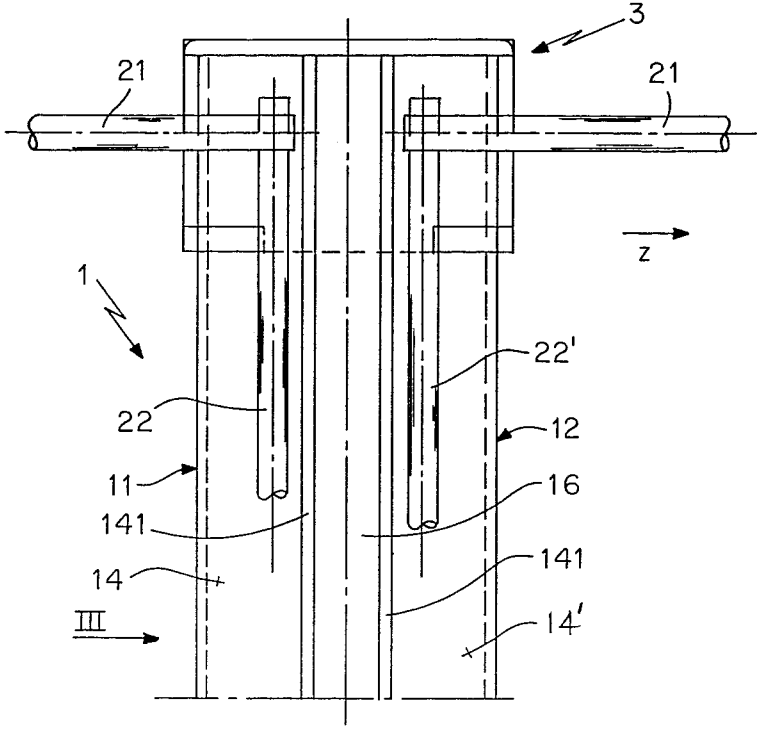
FIG. 2 is a view along the direction indicated by arrow II in FIG. 3 of the top of a post provided with the cap and associated with woven fencing.

The rectangular cross-section illustrated in FIGS. 2 and 3 has walls 11 and 12 that extend transversely across the enclosure, a wall 13 that faces away from the surface that comes into contact with the fencing, and a wall 14 and 14' that constitutes the surface that comes into contact with the fencing and has sections 14 and 14' that merge into outwardly bent edge sections 141 and 141' and demarcate a longitudinal slot 16.

The woven fencing associated with post 1 is represented in FIGS. 2 and 3 by its upper longitudinal rod 21 and by its first and last vertical rod 22 and 22' respectively.

Figure 1:
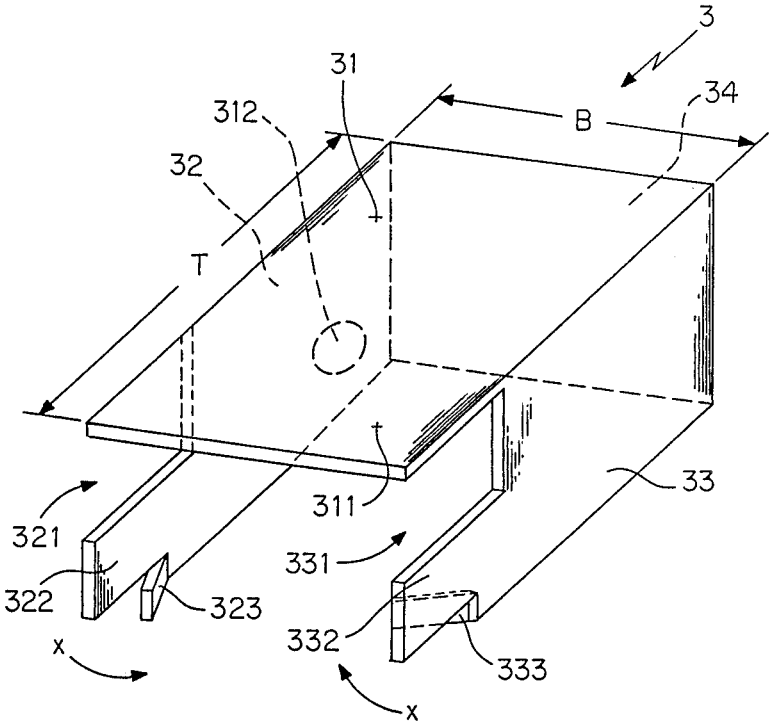
FIG. 1 is a schematic illustration of the novel cap-like post cover.

The width B of the cap-shaped post cover 3 illustrated in FIG. 1 equals the width of post 1 and its depth T leaves an excess 311 that extends transversely across post 1. Another feature of cap 3 is that the edge of excess 311 is recessed such that the edge sections 32, 33, and 34 of the cap all extend out of the actual cover 31 and come into contact with the walls 11 and 12 of the post that extend transversely across the enclosure and with the wall 13 that faces away from the surface that comes into contact with the fencing 21, 22, . . . , 22', whereby edge sections 32 and 33 have jogs 321 and 331 in the vicinity of the excess 311 on, and commencing with, cover 31 and the remaining excess on edge sections 32 and 33 is slit down to the base to create webs 322 and 323 or 332 and 333.

Cap 3 is positioned or forced over post 1 with its edge section 34 resting against the back 13 of the post (cf. FIG. 3 in particular). The webs 323 and 333 on the excesses 32 and 33 on the cap's edges are then bent down against post 1 in the direction indicated by arrow X in FIG. 1, initially securing cap 3 against post 1. Woven fencing 21, 22, . . . , and 22' is then applied to post 1 with upper longitudinal rods 21 and 21 fitting into the jogs 321 and 331 in the excesses on the sections 32 and 33 of the cap's edge and with the first and last vertical rod 22 and 22' in fencing 21, 22, . . . , 22' between the bent-down edge sections 141 and 141', which demarcate the longitudinal slot 16 in post 1, on sections 14 and 14' of the slotted wall 14 and 14' that constitutes the surface that the fencing rests against and remaining edge sections 322 and 332. The initial function of cap 3 is accordingly simply to facilitate assembly.

The woven fencing, suspended from cap 3, is then permanently secured to post 1 in a known way by means of an unillustrated strip that covers the joints 22 and 22' of the fencing and snaps into longitudinal slot 16. Once the enclosure has been completely assembled, the sections of fencing will alternately block both one another and cap 3 to the extent that the excesses on the cap's edges are covered by the upper longitudinal rods 21 and 21 in the fencing and the cap is secure against being pulled off in the direction indicated by arrow Y in FIG. 3, whereas the fencing is also secured against being pulled off by tension along the circumference of the enclosure, in the direction indicated by arrow Z in FIG. 2, by the edge excesses 322 and 332 that engage behind its first and last vertical rods 22 and 22'.

Sections 32 and 33 may have a perforation 312, as shown in FIG. 1. The sheet metal blank is, furthermore, a stamping with bent-down edge sections having welded abutting edges.

We claim:

1. A cap with a cover for covering a post having an axis and a rectangular-shaped cross-section with a width and depth for holding woven fencing having longitudinal rods, comprising: a sheet metal blank forming said cap; said cover being a component of said sheet metal blank and being securable to said post; said cover having a width equal to the width of said post and having a depth greater than the depth of the post; said cap having an excess portion extending beyond the depth of the post with cut-outs along a section of an edge adjacent to the post; sections connected to said cover and having free ends adjacent to said cut-outs; said free ends of said sections having joggs extending from said cover along the axis of the post and matching cross-sections of said longitudinal rods in said fencing; said sections having excess portions with slits to form webs extending to bases of said excess portions.

2. A cap as defined in claim 1, wherein said cover has an excess portion extending beyond said post and substantially as far as said woven fencing is thick.

3. A cap as defined in claim 1, wherein said webs formed by said slits are unsymmetrical, said slits forming an upper web and a lower web, said upper web being higher than said lower web.

4. A cap as defined in claim 3, wherein said lower web has a bending edge to be bent downward; and a forward-facing stamped out section in said bending edge of said lower web.

5. A cap as defined in claim 1, wherein said sheet metal blank comprises further a stamping with bent-down edge sections having welded abutting edges.

6. A cap as defined in claim 1, wherein surfaces of said cap are surface-treated.

7. A cap as defined in claim 1, wherein at least one of said sections has a perforation.

8. A cap with a cover for covering a post having a rectangular-shaped cross-section with a width and depth for holding woven fencing having longitudinal rods, comprising: a sheet metal blank forming said cap; said cover being a component of said sheet metal blank and being securable to said post; said cover having a width equal to the width of said post and having a depth greater than the depth of the post; said cap having an excess portion extending beyond the depth of the post with cut-outs along a section of an edge adjacent to the post; sections connected to said cover and having free ends adjacent to said cut-outs; said free ends of said sections having joggs extending from said cover to the cross-section of the post and matching cross-sections of said longitudinal rods in said fencing; said sections having excess portions extending beyond the depth of the post with slits to form webs extending to bases of said excess portions; said cover having an excess portion extending beyond said post and substantially as far as said woven fencing is thick; said excess portions being slit into unsymmetrical webs, said webs comprising an upper web and a lower web, said upper web being higher than said lower web; said lower web having a bending edge bent downward, and a forward-facing stamped-out section in said bending edge of said lower web; said sheet metal blank comprising a stamping with bent-down sections having welded abutting edges; at least one of said sections having a perforation; surfaces of said cap being surface-treated.

* * * * *